United States Patent [19]

Dollenmayer

[11] 4,427,312

[45] Jan. 24, 1984

[54] PRINTWHEEL DETENT

[75] Inventor: William L. Dollenmayer, Versailles, Ky.

[73] Assignee: International Business Machines Corporation, Armonk, N.Y.

[21] Appl. No.: 415,859

[22] Filed: Sep. 8, 1982

[51] Int. Cl.[3] ..... B41J 1/30

[52] U.S. Cl. ..... 400/144.2; 400/157.1; 400/169; 400/174

[58] Field of Search ..... 400/144.2, 144.3, 157.1, 400/157.2, 144, 144.1, 144.4, 169, 174; 101/93.48, 93.19

[56] References Cited

U.S. PATENT DOCUMENTS 3,840,105 10/1974 Kittredge ..... 400/144.3

4,335,970 6/1982 Iwata et al. ..... 400/144.2

*Primary Examiner*—Edgar S. Burr

*Assistant Examiner*—Charles A. Pearson

*Attorney, Agent, or Firm*—William J. Dick

[57] ABSTRACT

A printwheel 20 for a daisy wheel printer 10, the printwheel 20 including a hub portion 23 and a plurality of radially extending, deflectable petals 21 projecting therefrom. The petals include a pad or tip 24 thereon with print forming indicia on one surface 24*a* thereof and a striking surface on the opposite surface 24*b* thereof adapted to be struck by a print hammer 30 to move the indicia against paper 16 or other print receiving medium. The striking surface 24*b* comprises first and second, axially projecting inclined surfaces 25, 26, each of the inclined surfaces being disposed, with respect to the other, to subtend an angle 'AN' therebetween in plan. The striking surface 24*b* is disposed in such a manner as to be engaged by complementary inclined surfaces 32, 33 on the print hammer 30 whereby angular misalignment between the hammer 30 and the petal 21 may be compensated for by lateral deflection of the petal 21 to effect a detenting between the complementary inclined surfaces 25, 26 of the petal 21 and the print hammer 30.

8 Claims, 6 Drawing Figures

PRINTWHEEL DETENT

TECHNICAL FIELD

The present invention relates to printers having print wheels of the daisy wheel type and cooperating print hammers, and more particularly relates to a printwheel detent in which the permissible angular misalignment of the printwheel petal to the hammer during printing is approximately double that of existing detent designs.

THE PRIOR ART

The problem of the interaction between the petals of a daisy wheel type printwheel and the cooperating hammer which serves to strike the same to force the petal against the ribbon and then the paper, is a study in dynamics. The daisy wheel rotates for character selection, (i.e., to place the selected petal opposite the hammer) and the hammer then must strike the petal and be removed prior to continued rotation of the wheel for the subsequent character selection. This sequence presents a significant problem relative to alignment of the indicia carrying petals of the printwheel and the hammer. Additionally, timing must be critically controlled to insure proper operation.

Presently, to insure such alignment, the hammer tip (which strikes the rear of a print petal of a printwheel) is V-notched and cooperates with a like V projection on the rear of the print petal. For example, see *IBM Technical Disclosure Bulletin,* "Type Disk-Hammer Detent," Vol. 18, No. 2, July 1975, p. 371. This article discloses a V-notch, V-projection, hammer-printwheel for achieving proper petal to hammer alignment. This permits slight misalignment of the petal and hammer because the cooperating V's cause or force hammer to petal alignment. In effect, the petal is resilient and is deflected by the more massive and rigid hammer, the deflection occurring in the plane of the printwheel. The deflection which forces correct character position is sometimes referred to as "angular" alignment.

While the above mentioned means for insuring proper petal to hammer alignment is effective with slight misalignment, timing is still critical and if any more than slight misalignment occurs, the petal will not be struck properly by the hammer causing a misaligned character to be printed, no character printed at all, or breakage of the petal of the wheel.

Of course it is possible to allow for greater misalignment by merely widening the pad or tip of the petal (where the hammer strikes the petal), but with small radius printwheels and the great number of characters (usually 96 or more) on the wheel, insufficient room exists for significant increases in the width of the petal tip unless the wheel diameter is increased. Increasing the wheel diameter increases the wheel centrifugal force during rotation (character selection) causing further misalignment possibilities.

There are other ways in which to accomplish the desired result of effecting proper alignment of a printwheel petal and hammer for proper printing. For example, in U.S. Pat. No. 4,338,034, issued on July 6, 1982, is disclosed a printwheel positioning means. The printwheel has coarse and fine alignment teeth which permit first a rough alignment of the petal with the print hammer and then a fine alignment utilizing fine teeth. This requires the use of an auxiliary element on the wheel selection driver (an electromagnet) to allow engagement of first the coarse teeth and then the fine teeth, requiring engagement and then disengagement of the electromagnet. This adds complexity to the system and further complicates the already rigid timing requirements.

DISCLOSURE OF THE INVENTION

In view of the above it is a principal object of the present invention to provide a printwheel detent which permits of up to double the permissible misalignment of printwheel and hammer over that of any existing design and without increasing the width of the printwheel petal pads or tips, and without increasing the complexity or timing associated problems of state-of-the-art printwheel systems.

In the present instance this is accomplished by providing on the rear or opposite side of the indicia carrying print petal, a specially contoured striking surface which coacts with a complementary striking surface on the tip of the print hammer to compensate for misalignment and insure that the indicia on the print petal strikes its predetermined and desired position.

The net result is a decided advantage by allowing up to double the permissible misalignment of printwheel and hammer. This means that the manufacturing cost of the printer may be reduced by allowing less stringent selection system design while maintaining maximum print speed.

Other objects and advantages of the present invention may be seen by referring to the following specification and claims taken in conjunction with the accompanying drawings in which:

DRAWING DESCRIPTION

BEST MODE FOR CARRYING OUT THE INVENTION

BACKGROUND

Figure 1:
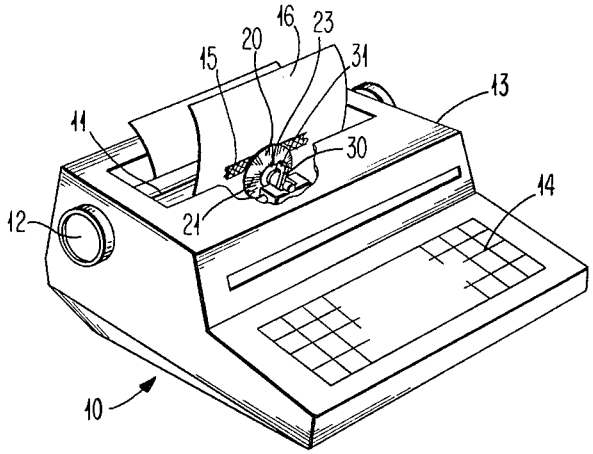
FIG. 1 is a fragmentary perspective view of a printer incorporating the subject matter of the present invention.
Figure 2:
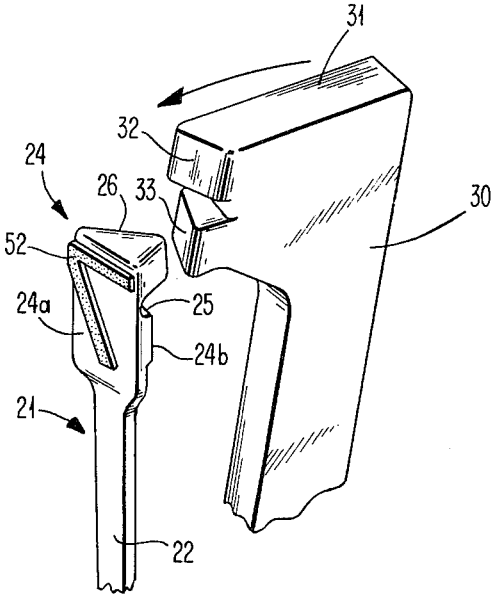
FIG. 2 is an enlarged fragmentary perspective view of a portion of the apparatus illustrated in FIG. 1 and showing a printwheel and cooperating hammer structure constructed in accordance with the present invention.

Turning now to the drawings, and particularly FIG. 1 thereof, a printer 10, in the present instance a typewriter, is depicted including a printwheel 20 and cooperating hammer 30 constructed in accordance with the present invention. The printer 10 includes the typical platen 11, platen knobs 12, cover 13, and if a typewriter, a keyboard 14. In a well known manner, the hammer 30 is energized to strike, at predetermined times, a selected one of the petals 21 which has been rotated into position opposite the hammer. The selected petal, after being struck, is propelled forward by the hammer tip 31 to press indicia on the side opposite the struck side of the petal, against print ribbon 15 to place a character or other indicia upon paper 16, on the platen 11. The hammer structure may be of any well known type, for example a solenoid, electromagnet with lever etc.

Figure 3:
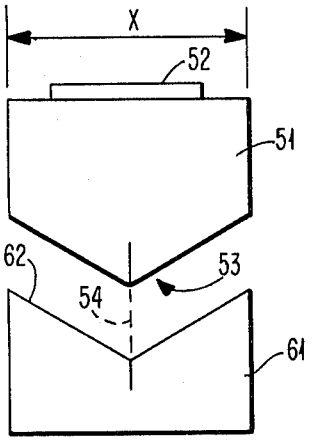
FIG. 3 is a schematic view in plan of a typical prior art printwheel and hammer.

A typical print petal pad or in the illustrated instance tip 51 and associated hammer tip 61 of the prior art is illustrated in FIG. 3. The petal pad or tip 51 includes indicia 52 on one side thereof and a hammer striking surface 53 on the opposite side thereof. As shown, the striking surface 53 is substantially V-shaped for coaction with a complementary V-shaped surface 62 on the hammer tip 61. Preferably the hammer tip 61 should mate with the striking surface 53 of the petal tip 51 along the dashed line 54. However if the print petal tip 51 is not aligned with the print hammer tip 61, the coaction of the sloped or inclined surfaces of the V causes lateral deflection of the resilient petal resulting in forced alignment and of course correct character placement.

From the foregoing, and the schematic illustration of FIG. 3, it is evident that the maximum misalignment that may occur between the petal tip 51 and hammer tip 61 is equal to X/2, where X is the width of the petal tip 51 and in the illustrated instance also the width of the hammer tip 61. In the instance one of the print hammer tip 61 or the petal tip 51 is smaller than the width of the other, the maximum misalignment correction that may be tolerated is ½ the width of the tip which has the recessed V striking surface, in the illustrated instance, the width of the hammer tip 61.

Figure 4:
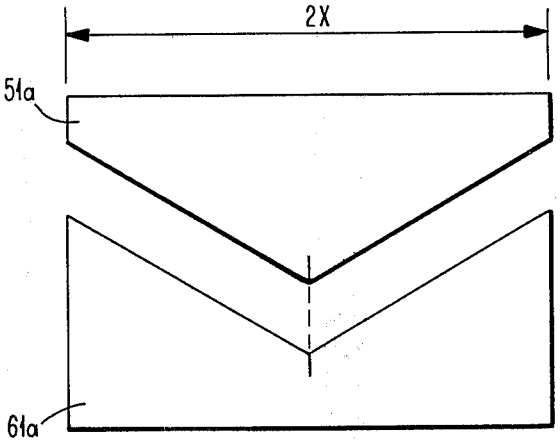
FIG. 4 is a schematic view in plan of a printwheel and hammer constructed as in the prior art to allow for double the misalignment between the printwheel and hammer.
Figure 6:
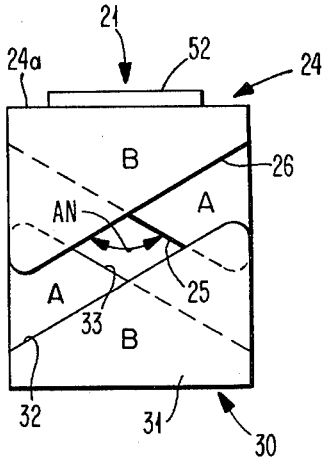
FIG. 6 is a view in plan of the printwheel and hammer structure shown in FIG. 2.

In the event that it is desired to increase the maximum misalignment that may be tolerated by the prior art design, it is only necessary to increase the width of the print petal tip (and of course the print hammer tip), such as the print petal tip 51*a* and print hammer tip 61*a* illustrated in FIG. 4. As shown in FIG. 4, the width of the print petal tip 51*a* and print hammer tip 61*a* is increased to 2 X which means that the maximum misalignment error that may be tolerated is X. While this is a viable solution for minimizing the criticality of timing and position, the attendant disadvantage of the inability of maintaining the same number of characters on a printwheel of a given diameter is normally, too great a loss. (It should be recognized that if the width of the print petal tip 51*a* was constructed with a width of X and the print hammer tip 61*a* had a width of 2X, while the tolerance to misalignment of a single petal would effectively be doubled, the problem of the tolerance to misalignment would not change. The reason for this is that the increased width of the hammer tip creates clearance or interference problems with adjacent print petal tips.)

THE IMPROVED PRINTWHEEL DETENT

In accordance with the invention, means are provided to permit up to double the misalignment between the petals of the printwheel and associated hammer while maintaining the width of the print petal and hammer tips as compared with the prior art structures illustrated in FIG. 3.

To this end, and referring now to FIGS. 1, 2, 5 and 6, each print petal 21 of the print wheel 20 includes a resilient spoke like member 22 which is connected at one end to a hub 23 of the printwheel 20. Radially spaced from the hub 23 is a petal pad or tip 24 having an indicia bearing surface 24*a* and a hammer striking surface 24*b*. The striking surface 24*b* comprises first and second, radially spaced apart, oppositely inclined, and projecting surfaces 25 and 26 respectively. Each of the inclined surfaces 25 and 26 is disposed, with respect to the other, to subtend (form or define) an angle 'AN' therebetween and to lie in plan (when viewed radially of the printwheel 20 or along the axis of a print petal 21) in superimposed, overlapping relation.

The striking surface 24*b* is disposed to be engaged by complementary inclined surfaces 32 and 33 on the print hammer tip 31. In this manner angular misalignment between the hammer 30 and a petal 21 may be compensated for by lateral deflection (in the plane of the printwheel 20) of the petal spoke or member 22 to thereby effect a detenting between the complementary inclined surfaces 25, 26 of the petal 21 and the complementary inclined surfaces 32 and 33 on the tip 31 of the print hammer 30.

Figure 5:
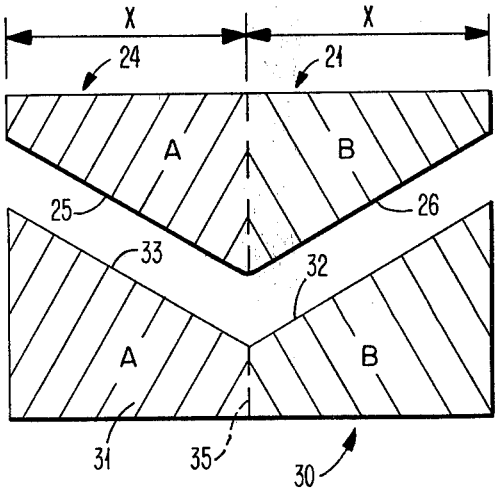
FIG. 5 is a fragmentary sectional view in plan of the printwheel and hammer shown in FIG. 2 but with the parts unfolded to illustrate the same result achieved by the apparatus of the present invention compared with the hammer of FIG. 4.

FIG. 5 is an unfolded view of the print petal pad or tip 24 and hammer tip 31 and more clearly illustrates the effect of the radially spaced apart, oppositely inclined surfaces 25, 26 on the print petal 24 and the complementary surfaces 33 and 32 on the hammer tip 31. As shown, if the printwheel tip 24 and hammer tip 31 were split in half along the dashed line 35, and then folded over so that the part B of the printwheel tip 24 and hammer tip 31 overlies part A respectively, the result is the structure of FIGS. 2 and 6.

Additionally, the result is a printwheel and hammer tip 24 and 31 which detents exactly the same as the printwheel tip 51*a* and hammer tip 61*a*. This is evident by comparing FIG. 4 and FIG. 5. The printwheel/hammer combination of the present invention detents exactly the same as the combination shown in FIG. 4 but is the same width X as the combination illustrated in FIG. 3. Therefore the printwheel tip and hammer fits into the same space as the conventional or prior art design of FIG. 3 while allowing up to twice the permissible misalignment of the prior art design. This means that the hammer 30 has double the ability to force the printwheel petal 21 into proper registration for correct character placement on the paper 16 as compared to the prior art design. Moreover, inasmuch as the number of petals on the printwheel need not be reduced and the diameter of the printwheel is not changed, the permissible angular misalignment has doubled. This is the true test of any improved detenting scheme.

Although the invention has been described with a certain degree of particularity, it is understood that the present disclosure has been made only by way of example and numerous changes in the detail of construction and the combination and arrangement of parts and the mode of operation may be made without departing from the scope of the invention as hereinafter claimed.

What is claimed is:

1. A printwheel for a printer, said printwheel including a hub portion and a plurality of radially extending petals projecting therefrom;

said petals having indicia on one surface thereof, and a striking surface on the opposite surface thereof;

said striking surface comprising first and second radially spaced apart inclined surfaces, each of said inclined surfaces comprising a generally planar surface extending substantially the full width of its associated petal, each of said inclined surfaces being disposed, with respect to the other, to subtend an angle, when viewed radially of said printwheel, between said inclined surfaces;

each of said inclined surfaces disposed to be engaged during every printing operation involving their associated indicia by complementary inclined surfaces on a print hammer whereby angular misalignment between said hammer and a petal may be compensated for by angular deflection of said petal to effect a detenting between said complementary inclined surfaces of said petal and said print hammer.

2. A printwheel for a printer in accordance with claim 1 wherein said inclined surfaces of said printwheel are in superimposed overlapping relation when viewed radially of said printwheel.

3. A printwheel in accordance with claim 1 wherein striking surface of said printwheel and said complementary inclined surfaces on said print hammer are of the same width.

4. A printwheel in accordance with claim 2 wherein said striking surface of said printwheel and said complementary inclined surfaces on said print hammer are of the same width.

5. A printwheel for a printer in accordance with claims 1 or 2 or 3 or 4 wherein deflection occurs approximately in the plane of the printwheel upon engagement of said striking surfaces and said complementary inclined surfaces.

6. A printwheel for a daisy wheel printer, said printwheel including a hub portion and a plurality of radially extending, deflectable petals projecting therefrom;

said petals having a pad thereon with print forming indicia on one surface thereof, and a striking surface on the opposite surface thereof adapted to be struck by a print hammer to move said indicia against a print receiving medium;

said striking surface comprising first and second, radially spaced apart, projecting inclined surfaces, each of said inclined surfaces comprising a generally planar surface extending substantially the full width of its associated petal, each of said inclined surfaces being disposed, with respect to the other, to define an angle therebetween when said striking surface is viewed axially of an associated petal;

each of said inclined surfaces disposed to be engaged during every printing operation involving their associated indicia by complementary inclined surfaces on said print hammer whereby angular misalignment between said hammer and a petal may be compensated for by lateral deflection of said petal to effect a detenting between said complementary inclined surfaces of said petal and said print hammer.

7. A printwheel for a daisy wheel printer in accordance with claim 6 wherein said striking surface of said printwheel and said complementary inclined surfaces on said print hammer are of the same width.

8. A printwheel for a daisy wheel printer in accordance with claims 6 or 7 wherein said inclined surfaces of said printwheel are in superimposed overlapping relation when viewed axially of said petals.

* * * * *